US005702658A

United States Patent [19]

Pellegrin et al.

[11] Patent Number: 5,702,658

[45] Date of Patent: Dec. 30, 1997

[54] BICOMPONENT POLYMER FIBERS MADE BY ROTARY PROCESS

[75] Inventors: Michael T. Pellegrin; Patrick M. Gavin; Patrick L. Ault; James E. Loftus, all of Newark; Randall M. Haines, Frazeysburg; Virgil Morris, Newark, all of Ohio

[73] Assignee: Owens-Corning Fiberglas Technology, Inc., Summit, Ill.

[21] Appl. No.: 608,795

[22] Filed: Feb. 29, 1996

[51] Int. Cl.[6] ..... D01D 5/18; D01F 8/06; D01F 8/12; D01F 8/14

[52] U.S. Cl. ..... 264/172.14; 264/172.15; 264/172.17; 264/172.18; 264/211.1

[58] Field of Search ..... 264/172.14, 172.15, 264/172.17, 172.18, 211.1

[56] References Cited

U.S. PATENT DOCUMENTS

| | | | |
|---|---|---|---|
| 2,998,620 | 9/1961 | Stalego . | |
| 3,073,005 | 1/1963 | Tiede . | |
| 3,197,813 | 8/1965 | Le Grand . | |
| 4,115,620 | 9/1978 | Gupta et al. . | |
| 4,551,378 | 11/1985 | Carey . | |
| 5,108,827 | 4/1992 | Gessner . | |
| 5,167,764 | 12/1992 | Nielsen et al. . | |
| 5,244,614 | 9/1993 | Hagen . | |
| 5,284,704 | 2/1994 | Kochesky et al. . | |
| 5,419,951 | 5/1995 | Golz . | |
| 5,431,992 | 7/1995 | Houpt et al. . | |
| 5,468,275 | 11/1995 | Lin et al. | 264/211.1 X |
| 5,474,590 | 12/1995 | Lin | 264/211.1 X |
| 5,482,527 | 1/1996 | Czastkiewicz | 264/211.1 X |
| 5,514,199 | 5/1996 | Houpt | 264/211.1 X |

FOREIGN PATENT DOCUMENTS

| | | |
|---|---|---|
| 6-101116 | 4/1994 | Japan . |
| 6-264362 | 9/1994 | Japan . |
| 7-34326 | 2/1995 | Japan . |
| 7-216688 | 8/1995 | Japan . |
| 7-229022 | 8/1995 | Japan . |
| 95/12551 | 5/1995 | WIPO . |
| 95/12552 | 5/1995 | WIPO . |
| 95/12553 | 5/1995 | WIPO . |
| 95/12554 | 5/1995 | WIPO . |
| 95/12700 | 5/1995 | WIPO . |
| 95/12701 | 5/1995 | WIPO . |

OTHER PUBLICATIONS

R.A. Buckley and R.J. Phillips, "The Development of Bicomponent Fibers", Oct., 1969.

Aly El-Shiekh, "Self-Crimping Producer Yarns", 1990.

Andrzej Ziabicki, "Fundamentals of Fibre Formation" (undated).

Dr. T. F. Booke, "Bicomponent Fibers", Dec., 1993.

Takeshi Takamori, "Solder Glasses", Troy, New York, 1979.

*Primary Examiner*—Leo B. Tentoni

*Attorney, Agent, or Firm*—C. Michael Gegenheimer; Curtis B. Brueske

[57] ABSTRACT

In a method for making bicomponent polymer fibers, first and second molten polymers are supplied to a rotating spinner having an orificed peripheral wall. The molten polymers are centrifuged through the orifices as molten bicomponent polymer streams. The streams are cooled to make bicomponent polymer fibers.

20 Claims, 8 Drawing Sheets

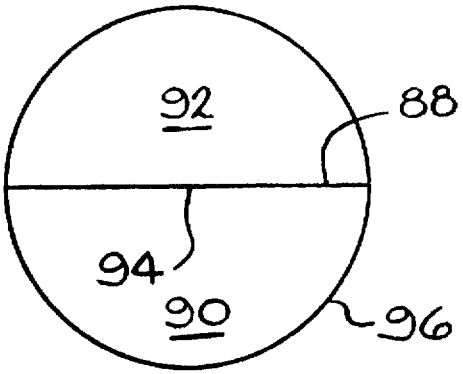
FIG. 8
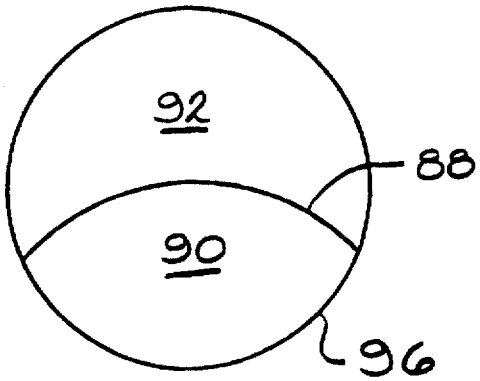
FIG. 9
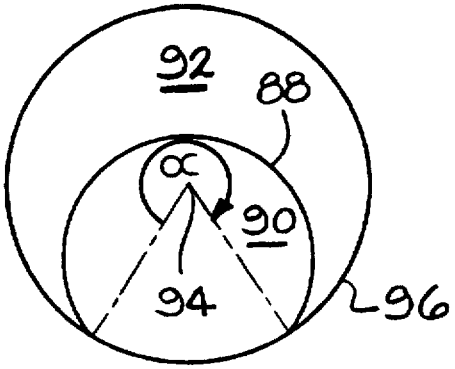
FIG. 10
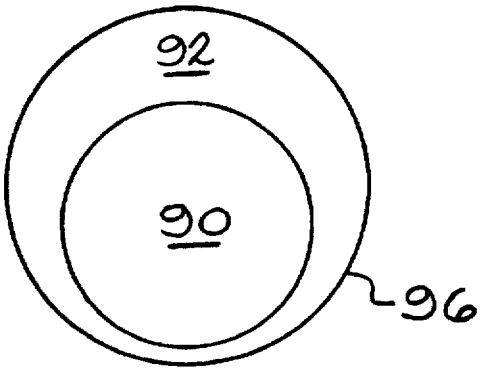
FIG. 11
FIG. 12
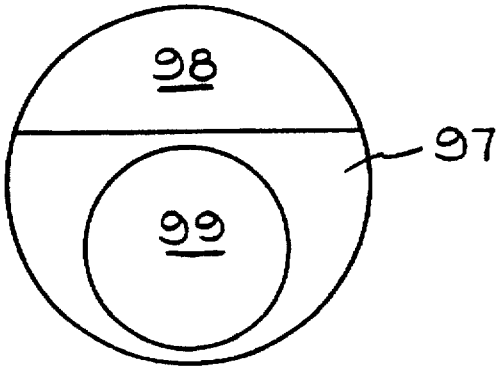

BICOMPONENT POLYMER FIBERS MADE BY ROTARY PROCESS

TECHNICAL FIELD

This invention relates in general to the manufacture of polymer fibers, and specifically to a method for manufacturing bicomponent polymer fibers by a modified rotary process.

BACKGROUND ART

Bicomponent mineral fibers, such as glass, have previously been made by a modified rotary process. Two different types of molten glass are supplied to a rotating spinner having an orificed peripheral wall. The two types of molten glass are centrifuged through the orifices to form bicomponent glass fibers. The fibers are particularly useful in insulation products.

The manufacture of glass fibers is a different field from the manufacture of polymer fibers. The two materials have different physical properties such as different viscosities and melting points. The technologies for making the fibers are also different.

Bicomponent polymer fibers have previously been made by a textile process. In this process, two molten polymers are supplied to a stationary spinneret having holes from which fibers are pulled or drawn. The polymers are usually combined to form fibers having a core of one polymer and a surrounding sheath of the other polymer. The fibers are useful in products such as fabrics and hosiery. For example, in a typical process two different types of nylon are formed into bicomponent fibers for making hosiery. The textile process usually makes bicomponent fibers having a relatively large diameter.

For some applications it is desirable to make bicomponent fibers from polymers that are difficult to fiberize together, or difficult to fiberize at all The polymers may be difficult to fiberize at all because they easily break apart during fiberizing. They may be difficult to fiberize together because they require different fiberizing conditions in view of their different physical properties. It would be advantageous to provide a method which, more easily than a textile process, can make bicomponent fibers from difficult to fiberize polymers.

For other applications, there are advantages to using bicomponent polymer fibers having a relatively small diameter. Therefore, it would also be advantageous to provide a method which can make small diameter bicomponent fibers more easily than a textile process.

DISCLOSURE OF THE INVENTION

This invention relates to a method for making multicomponent polymer fibers, and particularly bicomponent polymer fibers. In the method, first and second molten polymers are supplied to a rotating spinner having an orificed peripheral wall. The molten polymers are centrifuged through the orifices as molten bicomponent polymer streams. Then the streams are cooled to make bicomponent polymer fibers.

The bicomponent polymer fibers of this invention can be formed from polymers that are difficult to fiberize together, or difficult to fiberize at all. For example, the fibers can be formed from two polymers that have different coefficients of thermal expansion, to make curvilinear fibers for high loft wool packs or webs having excellent insulating properties. As another example, the fibers can be formed from two polymers that have different melting points to make heat fusible fibers. The method of this invention can easily form fibers having a small diameter.

BRIEF DESCRIPTION OF DRAWINGS

FIG. 8 is a schematic cross-sectional view of a bicomponent polymer fiber comprised of two different polymers.

FIG. 9 is a schematic cross-sectional view of a bicomponent polymer fiber in which differing viscosities of the two polymers enables the second polymer to flow partially around the first polymer.

FIG. 10 is a schematic cross-sectional view of a bicomponent polymer fiber in which the differing viscosities enables the lower viscosity second polymer to nearly enclose the higher viscosity polymer.

FIG. 11 is a schematic cross-sectional view of a bicomponent polymer fiber in which the lower viscosity polymer flows all the way around the higher viscosity polymer to enclose the higher viscosity polymer and form a cladding.

FIG. 12 is a schematic cross-sectional view of a tricomponent fiber formed of three different polymers.

BEST MODE FOR CARRYING OUT THE INVENTION

Figure 1:
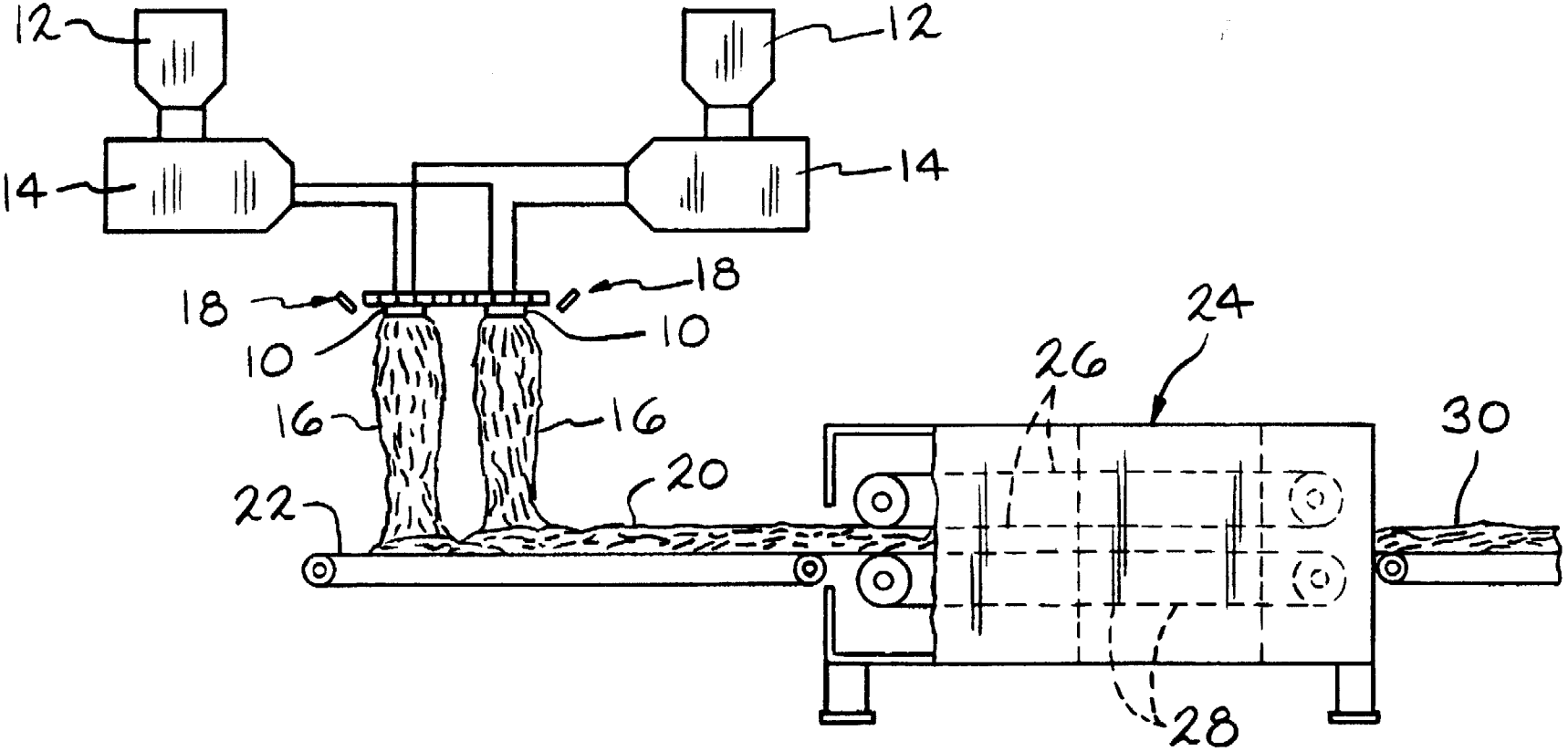
FIG. 1 is a schematic view in elevation of apparatus for carrying out the method of the invention for making bicomponent polymer fibers by a rotary process.

FIG. 1 illustrates a rotary fiber forming process for making insulation products from bicomponent polymer fibers in accordance with this invention. It is to be understood, however, that various fabrication processes can be used with the bicomponent polymer fibers to make textiles, filtration products, and other products. Such processes include stitching, needling, hydro-entanglement, and encapsulation. It is also understood that multicomponent fibers other than bicomponent fibers are included in the invention, and that the fibers can be formed from other thermoplastic materials such as asphalt in addition to polymers.

In the illustrated process, two distinct molten polymer compositions (polymer A and polymer B) are supplied to polymer spinners 10. The molten polymer compositions are supplied from any suitable source. For example, hoppers 12 containing polymer granules can be connected to extruders 14 where the polymers are melted and then supplied to the spinners. As will be described below, the spinners produce veils 16 of bicomponent polymer fibers. The fibers are directed downwardly by any means, such as by annular blower 18. As the fibers are blown downwardly, they are attenuated and cooled. The fibers are collected as a wool pack 20 on any suitable surface, such as conveyor 22. A partial vacuum, not shown, can be positioned beneath the conveyor to facilitate fiber collection.

The wool pack of bicomponent polymer fibers may then optionally be passed through a station for further processing, such as oven 24. While passing through the oven, the wool pack is preferably shaped by top conveyor 26 and bottom conveyor 28, and by edge guides (not shown). The wool pack exits the oven as insulation product 30.

Figure 2:
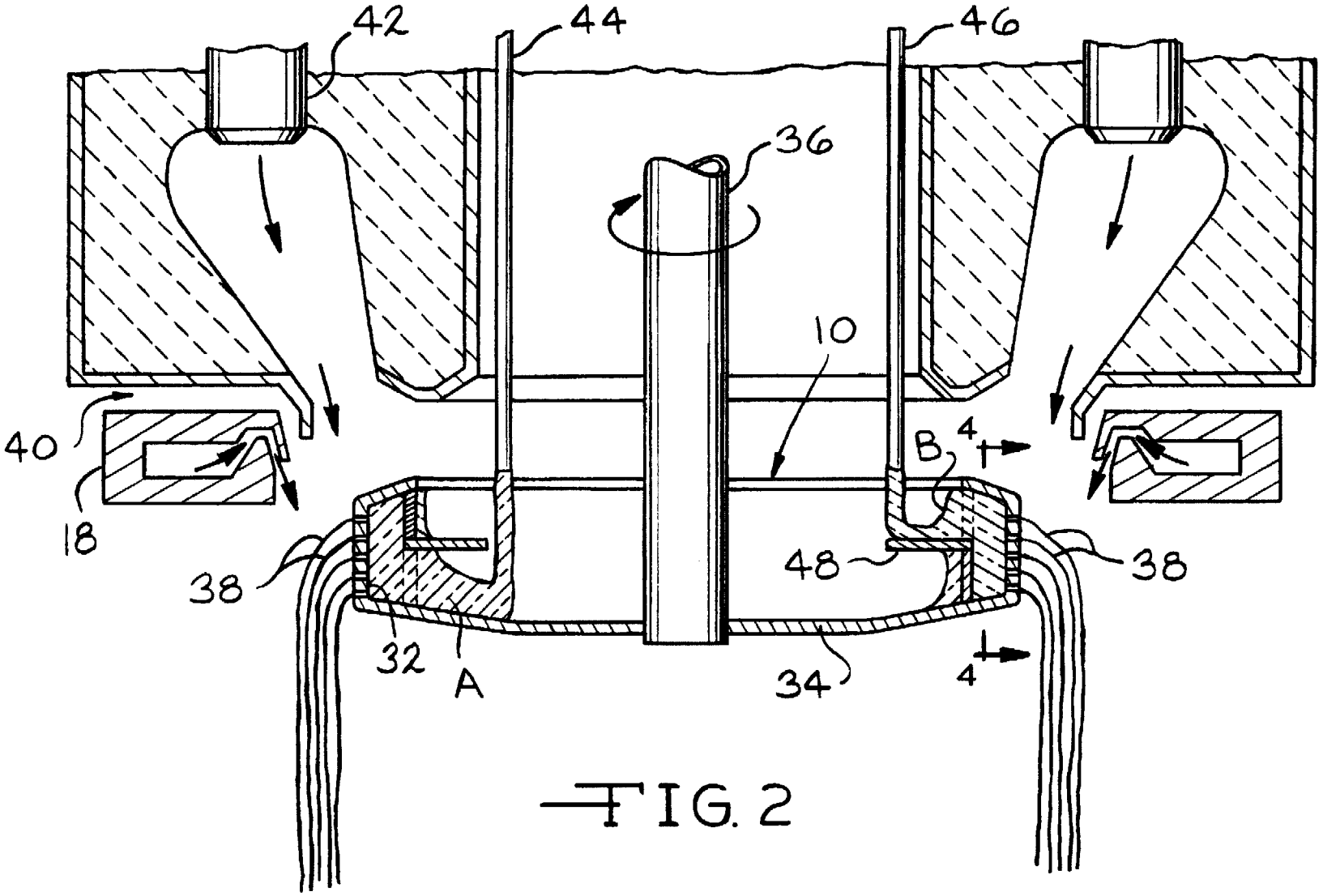
FIG. 2 is a cross-sectional view in elevation of a spinner by which bicomponent polymer fibers can be produced according to the invention.

As shown in FIG. 2, each spinner 10 includes a peripheral wall 32 and a bottom wall 34. The spinner is rotated on any suitable means, such as spindle 36, as is known in the art. The rotation of the spinner centrifuges molten polymer through orifices in the peripheral wall to form bicomponent polymer fibers 38, in a manner described in greater detail below. The spinner preferably rotates at a speed from about 1200 rpm to about 3000 rpm. Spinners of various diameters can be used, and the rotation rates adjusted to give the desired radial acceleration at the inner surface of the peripheral wall. The spinner diameter is preferably from about 20 centimeters to about 100 centimeters. The radial acceleration (velocity$^2$/radius) of the inner surface of the peripheral wall is preferably from about 4,500 meters/second$^2$ to about 14,000 meters/second$^2$, and more preferably from about 6,000 meters/second$^2$ to about 9,000 meters/second$^2$.

Annular blower 18 is positioned to direct the fibers downwardly for collection on the conveyor as shown in FIG. 1. Optionally the annular blower can use induced air 40 to further attenuate the fibers.

Preferably the interior of the spinner is heated by any heating means (not shown) such as by blowing in hot air or other gas. The temperature of the spinner is preferably from about 150° C. to about 300° C. but can vary depending on the type of polymers.

A heating means such as annular hot air supply 42 can optionally be positioned outside the spinner to heat either the spinner or the fibers, to facilitate the fiber attenuation and maintain the temperature of the spinner at the level for optimum centrifugation of the polymers.

The interior of the spinner is supplied with two separate streams of molten polymer, a first stream containing polymer A and a second stream containing polymer B. Preferably the streams of molten polymer are supplied by injection under pressure. The polymer A in the first stream drops from a first delivery tube 44 directly onto the bottom wall and flows outwardly due to the centrifugal force toward peripheral wall to form a head of polymer A as shown. Polymer B, delivered via a second delivery tube 46, is positioned closer to the peripheral wall than the first stream and polymer B is intercepted by annular horizontal flange 48 before it can reach the bottom wall. Thus, a build-up or head of polymer B is formed above the horizontal flange as shown. It is understood that the polymers could also be supplied so that polymer A is intercepted by the annular horizontal flange and polymer B drops to the bottom wall.

Figure 3:
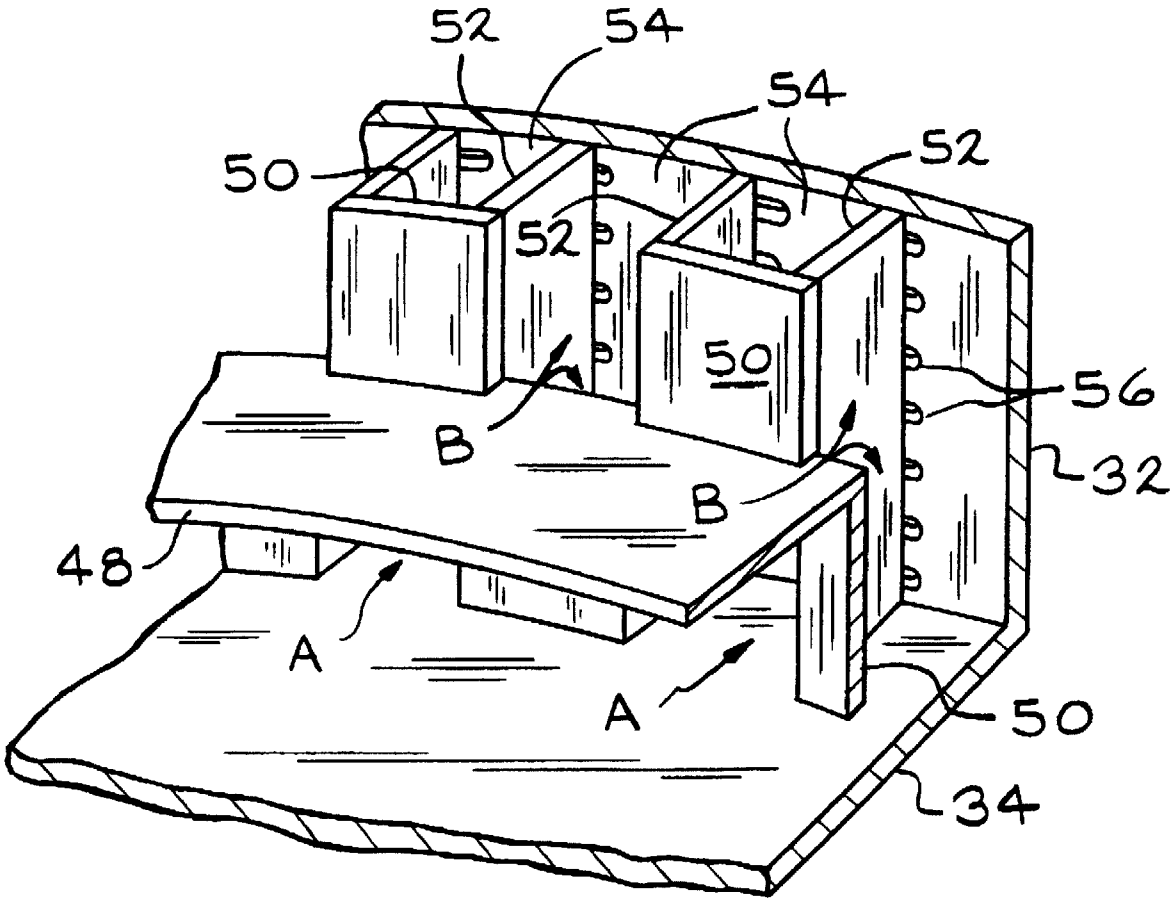
FIG. 3 is a schematic view in perspective of a portion of the spinner of FIG. 2.

As shown in FIG. 3, the spinner is adapted with a vertical interior wall 50 which is generally circumferential and positioned radially inwardly from the peripheral wall 32. A series of vertical baffles 52, positioned between the peripheral wall and vertical interior wall, divide that space into a series of generally vertically-aligned compartments 54 which run substantially the entire height of the peripheral wall. It can be seen that the horizontal flange, vertical interior wall, and vertical baffles together comprise a divider for directing polymers A and B into alternate adjacent compartments so that every other compartment contains polymer A while the remaining compartments contain polymer B.

The peripheral wall is adapted with orifices 56 which are positioned adjacent the radially outward end of the vertical baffle 52. Each orifice has a width greater than the width of the vertical baffle, thereby enabling a flow of both polymer A and polymer B to emerge from the orifice as a single bicomponent polymer fiber. As can be seen in FIG. 3, each compartment 54 runs the entire height of the peripheral wall 32 with orifices along the entire vertical baffle separating the compartments. Preferably, the peripheral wall has from about 200 to about 5,000 orifices, depending on the spinner diameter and other process parameters.

Figure 4:
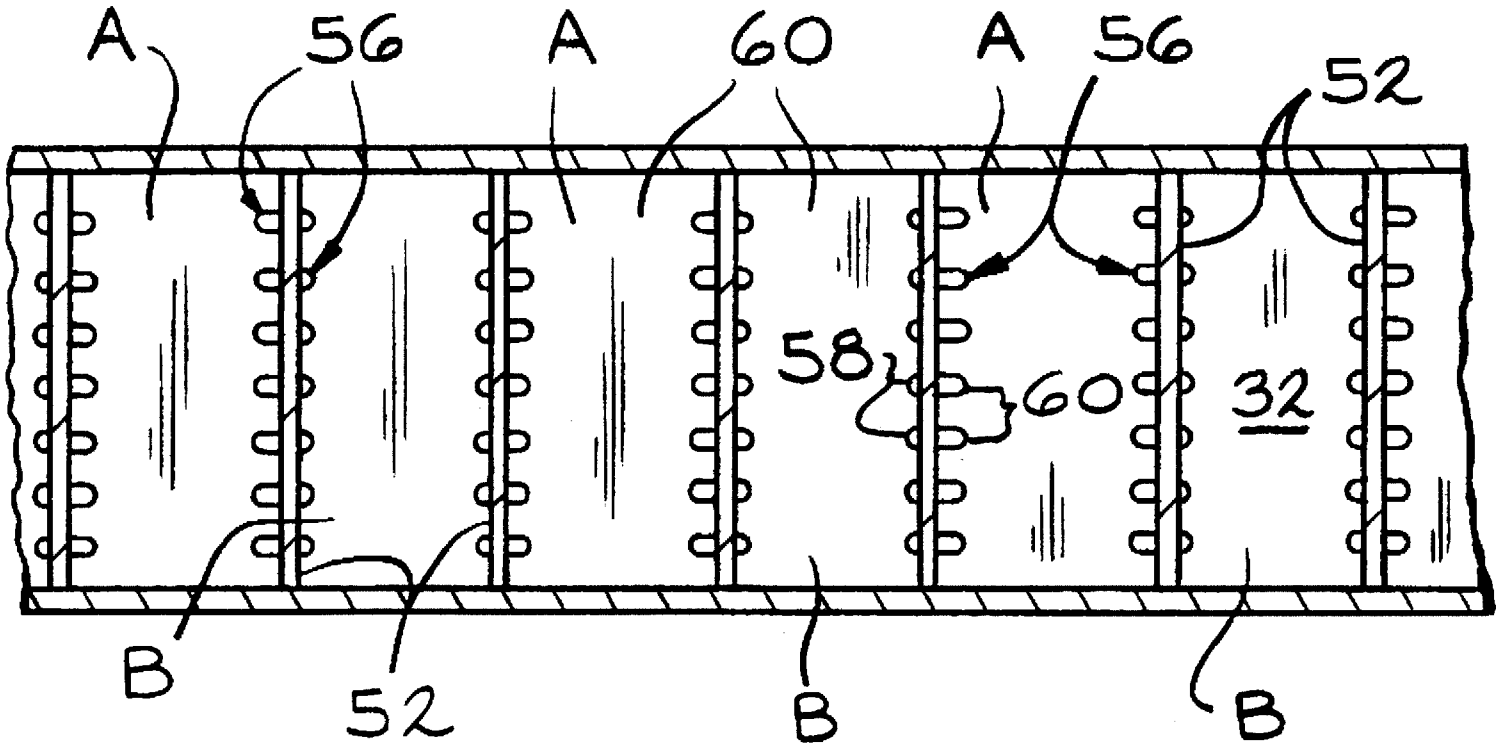
FIG. 4 is a schematic view in elevation of the spinner of FIG. 2, taken along line 4—4 of FIG. 2.

As shown in FIG. 4, the orifices 56 are in the shape of slots, although other shapes of orifices can be used. Where polymers A and B have different viscosities at the temperature of the spinner peripheral wall, an orifice perfectly centered about the vertical baffle 52 would be expected to emit a higher throughput of the lower viscosity polymer than the throughput of the higher viscosity polymer. One method to counteract this tendency and to balance the throughputs of the molten polymers, is to increase the height of the head of the higher viscosity polymer relative to the height of the head of the lower viscosity polymer in the spinner. Another method to balance the throughputs of the molten polymers is to position the slot orifice so that it is offset from the centerline of the vertical baffle. As shown in FIG. 4, the orifice will have a smaller end 58 which will restrict the flow of the lower viscosity polymer, and a larger end 60 which will enable a comparable flow or throughput of the higher viscosity polymer. Another method to balance the throughputs of the molten polymers is to restrict the flow of polymer into the alternate compartments containing the low viscosity polymer, thereby partially starving the holes so that the throughputs of polymers A and B are roughly equivalent. The orifice can also be centered about the vertical baffle when the polymers have similar viscosities or when different throughputs are desirable.

Figure 5:
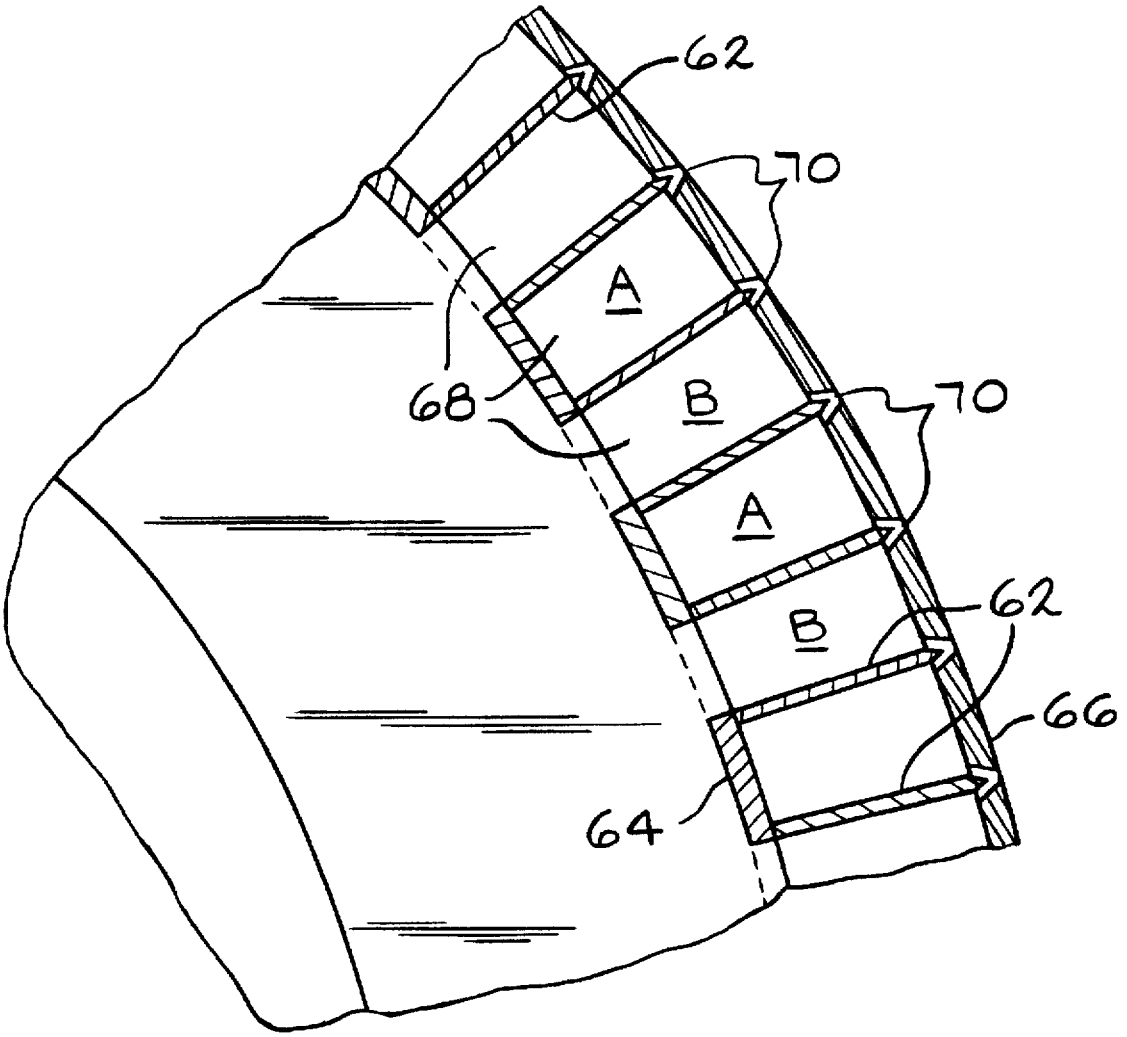
FIG. 5 is a plan view of a portion of a second embodiment of a spinner for making bicomponent polymer fibers.

FIG. 5 illustrates a portion of a second embodiment of the spinner. Like the first embodiment shown in FIG. 4, the spinner is adapted with vertical baffles 62 extending between a vertical interior wall 64 and the peripheral wall 66 to form compartments 68. The peripheral wall is adapted with rows of orifices 70 which are positioned adjacent the radial outward end of the vertical baffle. The orifices are in the shape of a "V", with one end or leg leading into a compartment containing polymer A and one leg leading into a compartment containing polymer B. The flows of both polymer A and polymer B join and emerge from the orifice as a single bicomponent polymer fiber.

Figure 6:
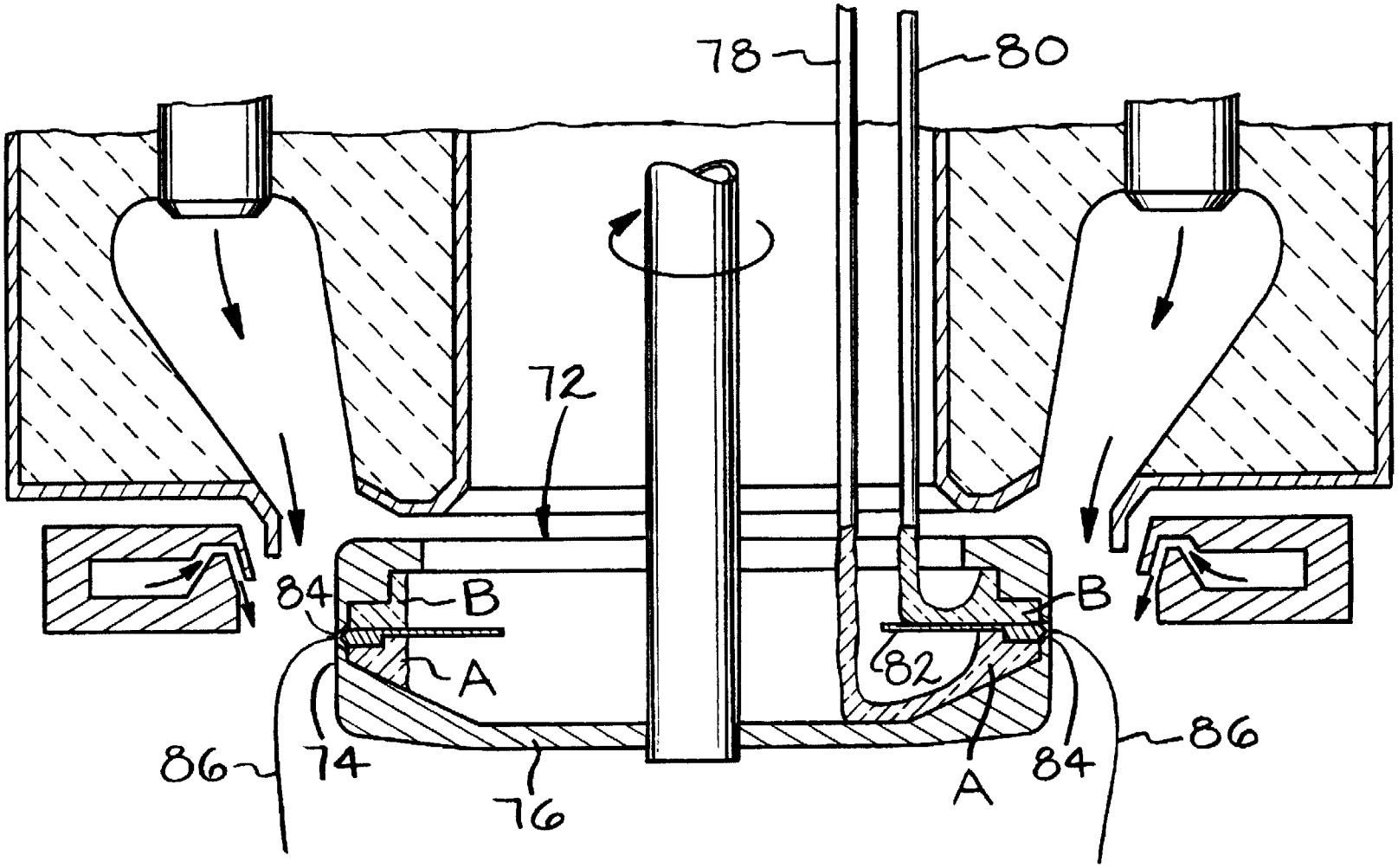
FIG. 6 is a cross-sectional view in elevation of a third embodiment of a spinner for making bicomponent polymer fibers.

FIG. 6 illustrates a third embodiment of the spinner. The spinner 72 includes a peripheral wall 74 and a bottom wall 76. The bottom wall slants upwardly as it approaches the peripheral wall. The interior of the spinner is supplied with two separate streams of molten polymer, a first stream containing polymer A and a second stream containing polymer B. The polymer in the first stream drops from a first delivery tube 78 directly onto the bottom wall and flows outwardly and upwardly due to the centrifugal force toward the peripheral wall to form a head of polymer A as shown. Polymer B, delivered via a second delivery tube 80, is positioned closer to the peripheral wall than the first stream, and polymer B is intercepted by annular horizontal flange 82 before it can reach the bottom wall. Thus, a build-up or head of polymer B is formed above the horizontal flange as shown.

Figure 7:
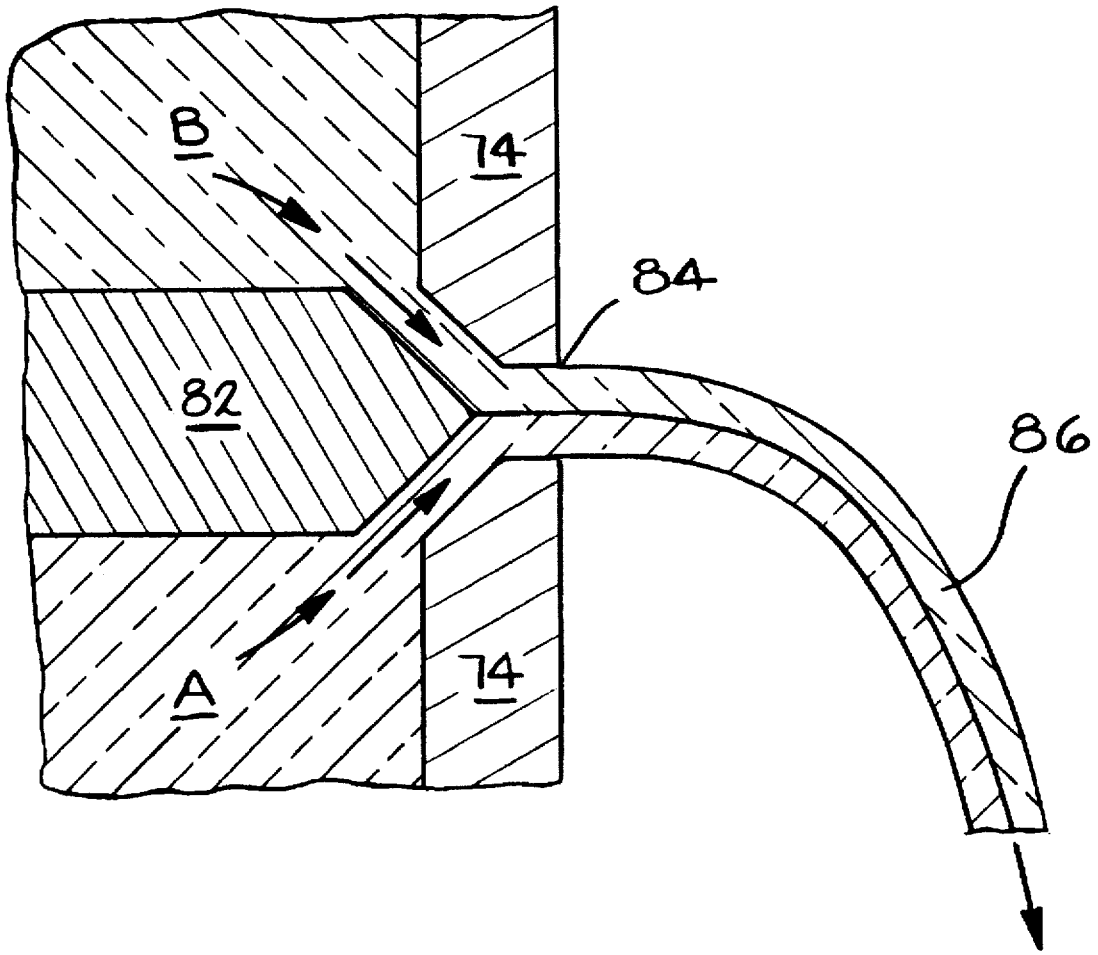
FIG. 7 is a cross-sectional view in elevation of the orifice of the spinner of FIG. 6.

The peripheral wall is adapted with a row of orifices 84 around its circumference, the orifices being positioned adjacent the radially outward end of the horizontal flange. As can be seen in FIG. 7, each orifice is in the shape of a "Y", with one arm leading to polymer A, the other arm leading to polymer B, and the base leading to the exterior of the peripheral wall. The flows of both polymer A and polymer B join and emerge from the orifice as a single bicomponent polymer fiber 86.

Other spinner configurations can also be used to supply dual streams of polymers to the spinner orifices.

The thermoplastic materials can be any heat softenable thermoplastic materials such as polymers or asphalt, including amorphous thermoplastic materials. In many applications it is desirable to use thermoplastic materials that have similar physical properties and are relatively easy to fiberize. However, the bicomponent fibers of this invention can also be formed from thermoplastic materials that are difficult to fiberize together, or difficult to fiberize at all. Advantageously, the present rotary process can form bicomponent fibers from difficult to fiberize thermoplastic materials much more easily than a textile process. The thermoplastic materials may be difficult to fiberize at all because they easily break apart during fiberizing. They may be difficult to fiberize together because they require different fiberizing conditions in view of their different physical properties.

For example, bicomponent fibers can be formed from two polymers that have different coefficients of thermal expansion. As each fiber cools, the polymer with the greater coefficient of thermal expansion contracts at a faster rate than the other polymer. The result is stress upon the fiber, and to relieve the stress, the fiber must bend into a curve. As a result, the bicomponent polymer fibers have an irregular, curvilinear nature. Such a curvilinear nature is particularly advantageous for giving the fibers excellent insulating properties when they are used in insulating materials or textiles. Preferably the coefficient of thermal expansion of one polymer is different from that of the other polymer by an amount greater than about 5.0 ppm/°C., and more preferably greater than about 10.0 ppm/°C. Examples of two polymers having significantly different coefficients of thermal expansion are polypropylene (68 ppm/°C.) and poly(ethylene terephthalate) (17 ppm/°C.).

As another example, bicomponent fibers can be formed from two polymers that have different melting properties. For purposes of this invention, melting points of thermoplastic materials such as polymers are determined using DSC (Differential Scanning Calorimetry). It is understood that use of the term "melting point" does not strictly apply to some classes of thermoplastic materials, specifically amorphous materials. In such cases, the term "melting point" means the temperature at which the material softens and is easily flowable so that it can be fiberized, as known to persons skilled in the art.

One application requiring polymers having different melting points is heat fusible bicomponent polymer fibers. A wool pack or web of the fibers can be fused together by heating to a temperature sufficient to melt the lower melting polymer but not the higher melting polymer. Such heat fusible bicomponent polymer fibers are useful in many nonwoven applications.

Preferably the melting point of the first thermoplastic material is at least about 10° C. greater than the melting point of the second thermoplastic material, and more preferably at least about 25° C. greater. Examples of relatively high melting or softening thermoplastic materials include, but are not limited to, poly(phenylene sulfide) ("PPS"), poly(ethylene terephthalate) ("PET"), poly(butylene terephthalate) ("PBT"), polycarbonate, polyamide, and mixtures thereof. Examples of relatively low melting or softening thermoplastic materials include, but are not limited to, polyethylene, polypropylene, polystyrene, asphalt, and mixtures thereof.

The rotary process of this invention can also form bicomponent fibers from two thermoplastic materials having significantly different viscosities. The viscosity of the first thermoplastic material can be different from that of the second thermoplastic material by a factor within the range of from about 5 to about 1000, and usually from about 50 to about 500. For purposes of this invention, the viscosity is measured at the temperature of the peripheral wall of the spinner.

Bicomponent polymer fibers having a small diameter can be formed more easily by the rotary process of this invention than by a textile process. This advantage is provided because the rotary process uses centrifugal force to attenuate the fibers instead of the mechanical attenuation of the textile process. Preferably the bicomponent polymer fibers have an average outside diameter of from about 5 microns to about 50 microns, and more preferably from about 5 microns to about 35 microns.

The rotary process of this invention can also produce a high loft nonwoven product similar to products made by a melt blowing process, without requiring the secondary processing steps typical of textile processes.

Each of the bicomponent polymer fibers of the present invention is composed of two different polymer compositions, polymer A and polymer B. If one were to make a cross-section of an ideal bicomponent polymer fiber, one half of the fiber would be polymer A, with the other half polymer B. In reality, a wide range of proportions of the amounts of polymer A and polymer B may exist in the fibers, or perhaps even over the length of an individual fiber. The percentage of polymer A may vary within the range of from about 5% to about 95% by weight of the total fiber, with the remainder being polymer B. In general, a group of fibers such as a wool pack will have many different combinations of percentages of polymer A and polymer B, including a small fraction of fibers that are single component. The preferred composition of the bicomponent fibers will differ depending on the application. For some applications, preferably the bicomponent fibers comprise, by weight, from about 40% to about 60% polymer A and from about 40% to about 60% polymer B.

Cross-section photographs of fibers can be obtained by mounting a bundle of fibers in epoxy with the fibers oriented in parallel as much as possible. The epoxy plug is then cross-sectioned and polished. The polished sample surface is then coated with a thin carbon layer to provide a conductive sample for analysis by scanning electron microscopy (SEM). The sample is then examined on the SEM using a backscattered-electron detector, which displays variations in average atomic number as a variation in the gray scale. This analysis may reveal the presence of two polymers by a darker and lighter region on the cross-section of the fiber, and shows the interface of the two polymers.

In FIGS. 8 through 12, polymer A is designated as polymer 90 and polymer B is designated as polymer 92. As shown in FIG. 8, if the ratio of polymer 90 to polymer 92 is 50:50, the interface 88 between polymer 90 and polymer 92 passes through the center 94 of the fiber cross-section. As shown in FIG. 9, where polymer 92 has a lower viscosity, polymer 92 can somewhat bend around or wrap around the higher viscosity polymer 90 so that the interface 88 becomes curved. This requires that the bicomponent polymer fiber stream emanating from the spinner be maintained at a temperature sufficient to enable the low viscosity polymer 92 to flow around the higher viscosity polymer 90. Adjustments in the spinner operating parameters, such as hot air flow rate, blower pressure, and polymer temperature, may be necessary to achieve the desired wrap of the low viscosity polymer.

As shown in FIG. 10, the lower viscosity polymer 92 has flowed almost all the way around the higher viscosity polymer 90. One way to quantify the extent to which the lower viscosity polymer flows around the higher viscosity polymer is to measure the angle of wrap, such as the angle alpha shown in FIG. 10. In some cases the lower viscosity polymer flows around the higher viscosity polymer to form an angle alpha of at least 270 degrees, i.e., the lower viscosity polymer flows around the higher viscosity polymer to an extent that at least 270 degrees of the circumferential surface 96 of the bicomponent polymer fiber is made up of the second polymer.

As shown in FIG. 11, under certain conditions the polymer 92 can flow all the way around the polymer 90 so that the polymer 92 encloses the polymer 90 to form a cladding. In that case, the entire circumferential surface 96 (360 degrees) of the bicomponent polymer fiber is the polymer 92 or the lower viscosity polymer.

The method of the invention is not limited to bicomponent fibers, but rather includes other multicomponent fibers such as the tricomponent fiber illustrated in FIG. 12. To form this tricomponent fiber, separate streams of first, second and third molten polymers 97, 98 and 99 are supplied to a rotating spinner having an orificed peripheral wall. The polymers are maintained separate until combined in the orifices. One method is to use a spinner having a single row of orifices like in FIG. 6, but where the area above the annular horizontal flange 82 is separated into alternate compartments like in FIG. 5. Thus, two streams could be fed into each orifice from above the flange while a third stream is fed into each orifice from below the flange. Other spinner structures can also be used. The first, second and third molten polymers are centrifuged through the orifices as a molten tricomponent stream, and the tricomponent stream is maintained at a temperature sufficient to enable one of the lower viscosity polymers to flow around at least one of the other polymers. Upon cooling of the tricomponent stream, a tricomponent fiber is formed. Another method to form a tricomponent fiber is to form a molten bicomponent stream of a first polymer and a blend of second and third polymers, where the second and third polymers have different physical properties so that they separate from one another upon cooling to form fibers. The multicomponent fibers can also include more than three components. The above descriptions and comparisons of the physical properties of the thermoplastic materials apply to each of the materials of a multicomponent fiber.

Bicomponent fibers in accordance with this invention include fibers in which the thermoplastic materials are disposed in side by side relation with one another. The rotary apparatus described above usually forms such side by side bicomponent fibers. The bicomponent fibers of this invention also include fibers in which one of the thermoplastic materials forms a core, while the other forms a sheath surrounding the core. The rotary apparatus can be specially constructed by methods known in the art to form sheath and core bicomponent fibers. In general, such apparatus feeds one molten component through orifices which form a sheath, and feeds the other molten component into the interior of the sheath to form a core. Combinations of different kinds of fibers can also be formed. The multicomponent fibers of the invention can also be shaped fibers, produced by shaping the orifice so that fibers are formed having a non-circular cross section. Methods of manufacturing shaped fibers are disclosed in U.S. Pat. Nos. 4,636,234 and 4,666,485 to Huey et al.

EXAMPLE

Bicomponent polymer fibers of this invention were formed from poly(phenylene sulfide) ("PPS") and poly (ethylene terephthalate) ("PET"). The PPS had a melting point of about 285° C., and the PET had a melting point of about 270° C. Separate streams of molten PPS and PET were supplied to the spinner illustrated in FIGS. 6 and 7 having a temperature of about 205° C. at the peripheral wall. At the temperature the polymers were delivered to the spinner, the PPS had a viscosity of about 4,000 poise and the PET had a viscosity of about 300 poise. The spinner had a diameter of about 20.3 centimeters and was rotated to provide a radial acceleration of about 7,600 meters/second$^2$. The spinner peripheral wall was adapted with 350 orifices. Bicomponent streams of molten PPS and PET were centrifuged through the orifices. The streams were cooled to make bicomponent polymer fibers which were collected as a wool pack. The average outside diameter of the fibers was about 25 microns.

The principle and mode of operation of this invention have been explained and illustrated in its preferred embodiment. However, it must be understood that this invention may be practiced otherwise than as specifically explained and illustrated without departing from its spirit or scope.

Industrial Applicability

The multicomponent fibers of this invention are useful in many applications including apparel products, thermal and acoustical insulation products, filtration products, and as binders in composite materials.

We claim:

1. A method for making multicomponent fibers of thermoplastic material comprising:

supplying at least first and second molten thermoplastic materials to a rotating spinner having an orificed peripheral wall;

centrifuging the molten thermoplastic materials through the orifices as molten multicomponent streams of thermoplastic material; and cooling the streams to make multicomponent fibers of thermoplastic material.

2. The method of claim 1 in which the multicomponent fibers are bicomponent fibers and the melting point of the first thermoplastic material is different from the melting point of the second thermoplastic material by an amount greater than about 10° C.

3. The method of claim 2 in which the melting point of the first thermoplastic material is different from the melting point of the second thermoplastic material by an amount greater than about 25° C.

4. The method of claim 1 in which the multicomponent fibers are bicomponent fibers and the coefficient of thermal expansion of the first thermoplastic material is different from the coefficient of thermal expansion of the second thermoplastic material by an amount greater than about 5.0 ppm/°C.

5. The method of claim 4 in which the coefficient of thermal expansion of the first thermoplastic material is different from the coefficient of thermal expansion of the second thermoplastic material by an amount greater than about 10.0 ppm/°C.

6. The method of claim 1 in which the multicomponent fibers are bicomponent fibers having an average outside diameter of from about 5 microns to about 50 microns.

7. The method of claim 6 in which the bicomponent fibers have an average outside diameter of from about 5 microns to about 35 microns.

8. The method of claim 1 in which the multicomponent fibers are bicomponent fibers and the viscosity of the first thermoplastic material is different from the viscosity of the second thermoplastic material by a factor within the range of from about 5 to about 1000.

9. The method of claim 1 in which the multicomponent fibers are bicomponent fibers, and additionally comprising the steps of collecting the bicomponent polymer fibers as a wool pack and subjecting the wool pack to a temperature greater than the melting point of the second polymer but less than the melting point of the first polymer.

10. The method of claim 1 in which the multicomponent fibers are bicomponent fibers and the melting point of the first polymer is different from the melting point of the second polymer by an amount greater than about 10° C., the coefficient of thermal expansion of the first polymer is different from the coefficient of thermal expansion of the second polymer by an amount greater than about 2.0 ppm/°C., and the fibers have an average outside diameter of from about 5 microns to about 50 microns.

11. The method of claim 10 in which the bicomponent fibers of thermoplastic material comprise, by weight, from about 40% to about 60% first thermoplastic material and from about 40% to about 60% second thermoplastic material.

12. The method of claim 10 in which the first thermoplastic material is a polymer selected from the group consisting of poly(phenylene sulfide), poly(ethylene terephthalate), poly(butylene terephthalate), polycarbonate, polyamide, and mixtures thereof.

13. The method of claim 10 in which the second thermoplastic material is a polymer selected from the group consisting of polyethylene, polypropylene, polystyrene, asphalt, and mixtures thereof.

14. A method for making bicomponent fibers of thermoplastic material comprising:

supplying first and second molten thermoplastic materials to a rotating spinner having an orificed peripheral wall, where the melting point of the first thermoplastic material is different from the melting point of the second thermoplastic material by an mount greater than about 10° C.;

centrifuging the molten thermoplastic materials through the orifices as molten bicomponent streams of thermoplastic material; and cooling the streams to make bicomponent fibers of thermoplastic material.

15. The method of claim 14 in which the coefficient of thermal expansion of the first thermoplastic material is different from the coefficient of thermal expansion of the second thermoplastic material by an amount greater than about 2.0 ppm/°C.

16. The method of claim 14 in which the bicomponent fibers have an average outside diameter of from about 5 microns to about 50 microns.

17. The method of claim 14 in which the first thermoplastic material is a polymer selected from the group consisting of poly(phenylene sulfide), poly(ethylene terephthalate), poly(butylene terephthalate), polycarbonate, polyamide, and mixtures thereof.

18. The method of claim 14 in which the second thermoplastic material is a polymer selected from the group consisting of polyethylene, polypropylene, polystyrene, asphalt, and mixtures thereof.

19. A method for making bicomponent fibers of thermoplastic material comprising:

supplying first and second molten thermoplastic materials to a rotating spinner having an orificed peripheral wall, where, the first thermoplastic material is a material selected from the group consisting of poly(phenylene sulfide), poly (ethylene terephthalate), poly(butylene terephthalate), polycarbonate, polyamide, polyethylene, polypropylene, polystyrene, asphalt, and mixtures thereof, and the second thermoplastic material is a different material selected from the group consisting of poly(phenylene sulfide), poly(ethylene terephthalate), poly(butylene terephthalate), polycarbonate, polyamide, polyethylene, polypropylene, polystyrene, asphalt, and mixtures thereof;

centrifuging the molten thermoplastic materials through the orifices as molten bicomponent streams of thermoplastic material; and cooling the streams to make bicomponent fibers of thermoplastic material.

20. The method of claim 19 in which the melting point of the first thermoplastic material is different from the melting point of the second thermoplastic material by an amount greater than about 10° C., and in which the viscosity of the first thermoplastic material is different from the viscosity of the second thermoplastic material by a factor within the range of from about 5 to about 1,000.

* * * * *